US007597282B2

(12) United States Patent
Endo et al.

(10) Patent No.: US 7,597,282 B2
(45) Date of Patent: Oct. 6, 2009

(54) CHANGEOVER APPARATUS AND METHOD FOR CHANGING OVER WINDING OF WEB

(75) Inventors: Hironobu Endo, Kanagawa (JP); Yoshihito Matsumura, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 15 days.

(21) Appl. No.: 12/047,574

(22) Filed: Mar. 13, 2008

(65) Prior Publication Data

US 2008/0223973 A1 Sep. 18, 2008

(30) Foreign Application Priority Data

Mar. 16, 2007 (JP) ..... 2007-069147

(51) Int. Cl.
*B65H 35/08* (2006.01)

(52) U.S. Cl. ..... 242/527; 242/527.1; 242/527.2; 242/527.6

(58) Field of Classification Search ..... 242/527, 242/527.1–527.4, 527.6–527.7, 533.4–533.5, 242/532.3

See application file for complete search history.

(56) References Cited

U.S. PATENT DOCUMENTS 3,552,670 A * 1/1971 Herman ..... 242/527.1
4,280,669 A * 7/1981 Leanna et al. ..... 242/527.1
6,851,642 B2 * 2/2005 Wilson et al. ..... 242/527.1
7,264,193 B2 9/2007 Hikita et al.

FOREIGN PATENT DOCUMENTS

JP 2005-89177 A 4/2005

* cited by examiner

*Primary Examiner*—Sang Kim
(74) *Attorney, Agent, or Firm*—Birch, Stewart, Kolasch & Birch, LLP

(57) ABSTRACT

A drum support arm supports a cutting drum with a sector cross section and a receiving drum with a circular cross section, and moves between a web winding changeover position for causing the receiving drum to contact a core and a spacing position for keeping the receiving drum away from the core. The guide roller moves between an approaching position for lifting a web from the receiving drum and a retracted position for causing the web contact a peripheral surface of the receiving drum. When the drum support arm moves to the web winding changeover position, the guide roller moves to the retracted position, and when the drum support arm moves to the spacing position, the guide roller moves to the approaching position. When the drum support arm is set to the web winding changeover position, the cutting drum rotates once to cut the web. A front end of the web formed by cutting is pressed against the core by the receiving drum and wound around the periphery of the core.

8 Claims, 5 Drawing Sheets

CHANGEOVER APPARATUS AND METHOD FOR CHANGING OVER WINDING OF WEB

FIELD OF THE INVENTION

The present invention relates to an apparatus and method for changing over winding of a web onto a new core, which is provided in a turret winder having plural winding spindles.

BACKGROUND OF THE INVENTION

A turret winder for automatically winding a web such as a plastic film transported continuously is known. The turret winder has plural winding spindles to which a core is removably attached respectively. One of the plural winding spindles is moved to a winding position to wind the web around a core of the winding spindle at the winding position. When a web having a predetermined length is wound around the core, another winding spindle holding a new core is moved to the winding position, and the web is wound around the new core. The winding of the web is changed over by a web winding changeover apparatus provided in the turret winder.

In Japanese Patent Laid-Open Publication No. 2005-89177 (corresponding to U.S. Pat. No. 7,264,193), a web winding changeover apparatus includes a cutting drum having a cutter whose form as viewed in a cross section is a sector shape, a receiving drum whose form as viewed in a cross section is a sector shape, and a drum support arm for supporting each of the drums such that peripheral surfaces of the drums contact each other. The drum support arm moves between a web winding changeover position where the receiving drum contacts a core and a retracted position where the receiving drum is retracted from the core located at the winding position. During changing over winding of a web, the drum support arm is moved to the web winding changeover position, and the cutting drum and the receiving drum are rotated once to cut the web. Further, a rear end of the web thus cut is wound around a core in a fully wound state, and a front end of the web formed by cutting is supplied toward a new core set at the winding position, and fixed to the new core by a double-sided adhesive tape adhered to a peripheral surface of the new core.

In order to increase productivity of the web, the change of conditions for producing the web, such as making the transporting speed of the web faster and making the width of the web wider, is considered. However, in a case where the web winding changeover apparatus disclosed in Japanese Patent Laid-Open Publication No. 2005-89177 is driven under the conditions described above, since the form of each of the drums as viewed in a cross section is a sector shape, each of the drums easily bend, and cutting defect of the web tends to be caused easily. Additionally, since the receiving drum is moved away from the new core immediately after the cutting of the web, tension toward backward direction is applied to the web at the upstream side in the transporting direction thereof. As a result, there arises a problem in which the front end of the web is easily peeled from the double-sided adhesive tape.

SUMMARY OF THE INVENTION

In view of the above, an object of the present invention is to provide a web winding changeover apparatus and method for surely winding a web around a new replaced core.

To achieve the above and other objects, according to the present invention, a web winding changeover apparatus includes a cutting drum, a receiving drum having a cross section of a circular shape, a drum support arm for supporting the cutting drum and the receiving drum in a rotatable manner, and a guide roller for guiding a web. During winding the web, the drum support arm is set to a spacing position (initial position) and a guide roller is set to an approaching position. When the drum support arm is in the spacing position, a transporting path for the web is formed between the cutting drum and the receiving drum. Further, when the guide roller is in the approaching position, the guide roller lifts the web such that the web does not contact with the receiving drum.

At the time of changing over winding of a web, a turret arm rotates to set a new core to a winding position. The drum support arm moves from the spacing position to the web winding changeover position. Further, the guide roller moves to a retracted position where the web contacts with the peripheral surface of the receiving drum. While the web is nipped between the receiving drum and the new core, the cutting drum rotates once to cut the web. A front end of the web formed by cutting is wound around the new core. After the web starts to be wound around the new core, the guide roller is returned to the approaching position, and the drum support arm is returned to the spacing position.

It is preferable that the cutting drum has a cross section of a sector shape. During winding the web, a cutout portion of the cutting drum faces toward the receiving drum. When the guide roller is set to the approaching position, the guide roller is present in the cutout portion of the cutting drum.

In a method for changing over winding of a web according to the present invention, at first, while a first core having a web roll is retracted, a second core, which is new, is set to a winding position. A drum support arm supporting a cutting drum having a cross section of a sector shape and a receiving drum having a cross section of a circular shape is moved from the initial position to a preparation position disposed between the initial position and the web winding changeover position, in other words, a preparation position disposed in front of a web winding changeover position. In the preparation position, the receiving drum is kept away from the second core. Next, the guide roller is moved from the approaching position to the retracted position. In the approaching position, the guide roller lifts the web such that the web does not contact with the peripheral surface of the receiving drum. In the retracted position, the web contacts with the peripheral surface of the receiving drum. During movement of the guide roller, the receiving drum is rotated in accordance with the transporting speed of the web. The drum support arm is moved to the web winding changeover position. In the web winding changeover position, the web is nipped between the receiving drum and the second core. The cutting drum in contact with the receiving drum is rotated once to cut the web. The second core starts rotating in synchronism with the cutting drum. The cutting drum stops at a position where the cutout portion faces with the receiving drum after cutting of the web. The front end of the web formed by cutting is fixed to the periphery of the second core. Thereafter, the web starts to be wound around the second core. The guide roller is moved to the approaching position, and drum support arm is returned to the initial position.

According to the present invention, since the receiving drum has a cylindrical shape, even if the cutting drum contacts the receiving drum, the receiving drum does not easily bend. Further, since the receiving drum can nip the web against the new core for a while after cutting of the web, it is possible to surely change over winding of the web.

Additionally, since the guide roller is provided to prevent the web from contacting the peripheral surface of the receiving drum, it is possible to prevent generation of scratches on the web. In particular, when the web is a protective film for a flat panel display device, it is important to prevent generation of scratches on the web in order to keep the product quality, and the present invention is preferably applicable.

BRIEF DESCRIPTION OF THE DRAWINGS

One with ordinary skill in the art would easily understand the above-described objects and advantages of the present invention when the following detailed description is read with reference to the drawings attached hereto.

DESCRIPTION OF THE PREFERRED EMBODIMENTS

Figure 1:
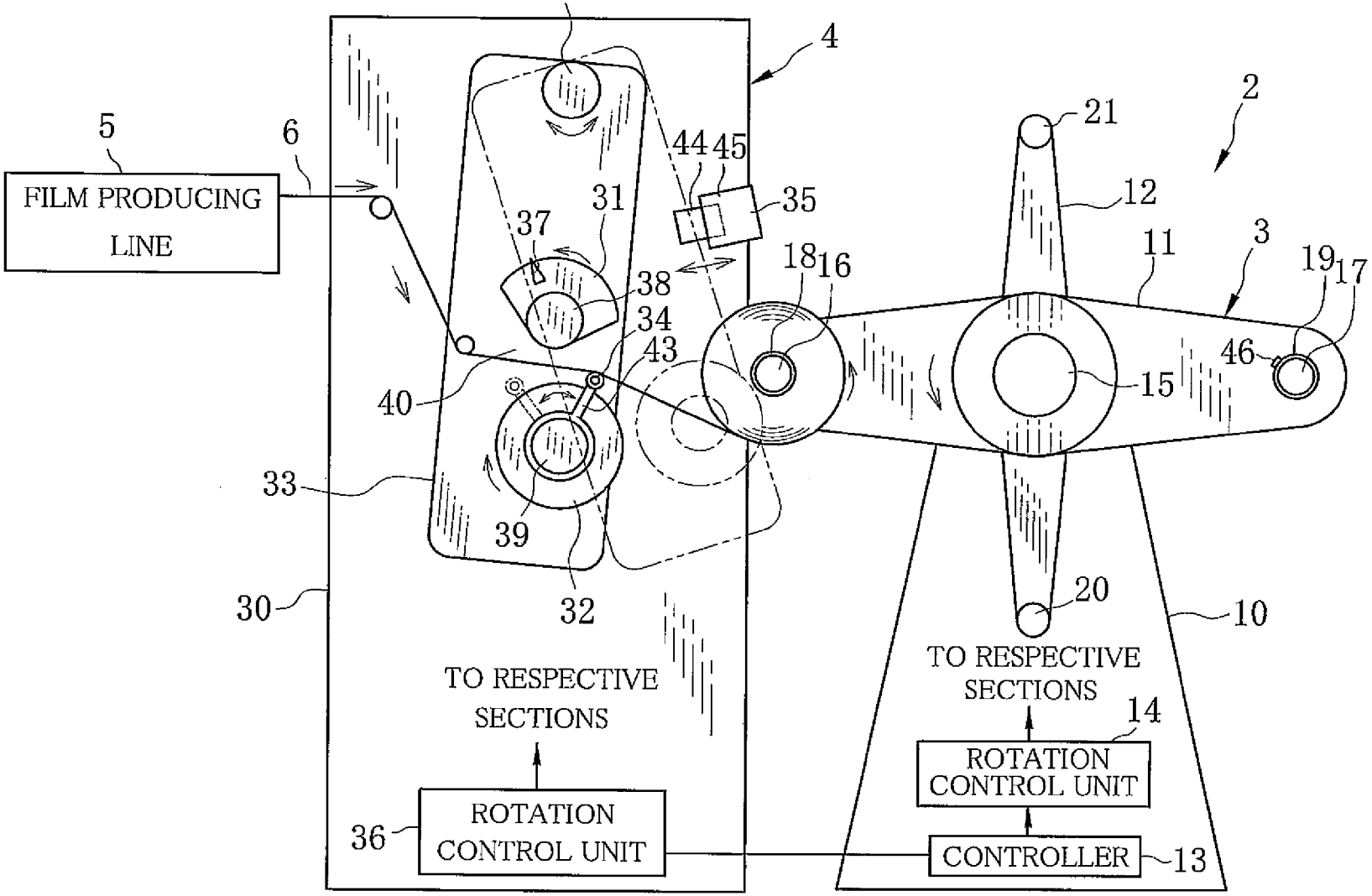
FIG. 1 is a schematic view illustrating a turret winder of the present invention.

As shown in FIG. 1, a turret winder 2 includes a web winding apparatus 3 and a web winding changeover apparatus 4. The turret winder 2 is used to wind a web 6, which is produced in a film producing line 5 and continuously transported, around a core. The web 6 is applicable to not only a plastic film but also paper, fabric, and the like.

The web winding apparatus 3 has a frame 10, a turret arm 11, an auxiliary arm 12, a controller 13, and a rotation control unit 14. The turret arm 11 and the auxiliary arm 12 are fixed to each other perpendicularly and rotated together around a rotary axis 15 provided in the frame 10. A winding spindle 16 is incorporated in one end of the turret arm 11, and a winding spindle 17 is incorporated in the other end of the turret arm 11. A core (first core) 18 is removably attached to the winding spindle (first winding spindle) 16, and a core (second core) 19 is removably attached to the winding spindle (second winding spindle) 17. A roller 20 is incorporated in one end of the auxiliary arm 12 in a freely rotatable manner, and a roller 21 is incorporated in the other end of the auxiliary arm 12 in a freely rotatable manner.

The controller 13 controls the web winding apparatus 3 and the web winding changeover apparatus 4 as a whole. The rotation control unit 14 is controlled by the controller 13 to cause the turret arm 11 and the auxiliary arm 12 to make half a rotation intermittently. In the intermittent rotation by 180°, the turret arm 11 stops its rotation so as to extend horizontally. While one of the winding spindles 16 and 17 is set to the winding position near the web winding changeover apparatus 4, the other of the winding spindles 16 and 17 is set to the retracted position away from the web winding changeover apparatus 4. Further, the rotation control unit 14 is controlled by the controller 13 to cause the winding spindles 16 and 17 to rotate.

The web winding apparatus 3 includes a sensor (not shown) for detecting a fully wound state of the core 18 or 19 located at the winding position. Upon detecting the fully wound state, the sensor sends a detection signal to the controller 13. Upon receiving the detection signal indicating the fully wound state, the controller 13 gives a command for changing over winding of the web. Note that a term "the fully wound state" is used to refer to a state in which a web roll obtained by winding the web 6 around the core have a predetermined diameter.

The web winding changeover apparatus 4 includes a base 30, a cutting drum 31, a receiving drum 32, a drum support arm 33, a guide roller 34, an engaging mechanism 35, and a rotation control unit 36. The cutting drum 31 is obtained by cutting a part of cylinder along the peripheral surface thereof, and has a cross section of sector shape. On the peripheral surface of the cutting drum 31, the cutter 37 is disposed with its blade directed to outside in a radial direction of the cutting drum 31 so as to cut the web 6 in the width direction thereof. The cutting drum 31 rotates around a rotary axis 38. The receiving drum 32 is a cylinder and rotates around a rotary axis 39. The peripheral surfaces of both the cutting drum 31 and the receiving drum 32 are made of rubber, however, the peripheral surface of one of the cutting drum 31 and the receiving drum 32 may be made from resin, metal, or the like.

As described above, the cutting drum 31 is formed by cutting a part of cylinder along the peripheral surface thereof, and a cutout portion of the cutting drum 31, whose part is cut away, is used as a transporting space 40 for the web 6. Thereby, the cutting drum 31 functions for forming the transporting space for the web.

The drum support arm 33 supports the cutting drum 31 and the receiving drum 32 in a rotatable manner. The peripheral surface of the cutting drum 31 and the peripheral surface of the receiving drum 32 contact each other during the rotation. The drum support arm 33 can swing about a rotary axis 41 provided in the base 30 by using a motor (not shown), and shifts between a web winding changeover position (shown by chain double-dashed lines) and a spacing position (shown by solid lines). In the web winding changeover position, the peripheral surface of the receiving drum 32 is pressed against the core 18 or 19 located at the winding position. In the spacing position, the peripheral surface of the receiving drum 32 is moved away from the core 18 or 19. The motor for rotating the drum support arm 33, the rotation control unit 36, and the controller 13 constitute a shifter for shifting the drum support arm 33.

The guide roller 34 is supported at a front end of a pair of guide roller support arms 43. The guide roller support arm 43 swings about the rotary axis 39. The rotary axis 39 is provided with the receiving drum 32. The guide roller support arm 43 moves between an approaching position (shown by chain double-dashed lines) for moving the guide roller 34 so as to approach the transporting space 40 and a retracted position (shown by solid lines) for moving the guide roller 34 so as to be retracted from the transporting space 40.

The rotation control unit 36 controls the swinging motion of the drum support arm 33, the rotation of the cutting drum 31 and the receiving drum 32, and the swinging motion of the guide roller support arm 43 based on instructions from the controller 13. Further, the rotation control unit 36 controls the rotation of the guide roller 34 in accordance with a transporting speed of the web 6. Since the guide roller 34 has a diameter smaller than that of the receiving drum 32 and thereby its rotation can be controlled at high precision, if the guide roller 34 contacts the web 6, no scratches are generated on the web 6.

The engaging mechanism 35 includes an engaging block 44 and a support 45. The engaging block 44 moves between a protruding position at which the engaging block 44 protrudes from the support 45 and a collapsed position at which the engaging block 44 intrudes into the support 45. When the engaging block 44 is located at the protruding position, even if the drum support arm 33 moves to the web winding changeover position, the engaging block 44 engages with the drum support arm 33 during the movement thereof, and therefore, the receiving drum 32 does not nip the web 6 against the core 18 or 19 located at the winding position. On the contrary, when the engaging block 44 is located at the collapsed position, the receiving drum 32 nips the web 6 against the core 18 or 19 located at the winding position.

Double-sided adhesive tape 46 is adhered to the core 19, such that the lateral side of the double-sided adhesive tape 46 extends along the width direction of the core 19. The web winding changeover apparatus 4 includes a tape position detecting sensor (not shown). When the core 19 moves to the winding position, the position of the core 19 to which the double-sided adhesive tape 46 is adhered is detected by the tape position detecting sensor. The detection signal from the tape position detecting sensor is sent to the controller 13.

Hereinafter, the operation of the above construction is described by referring to FIGS. 2 and 3. The winding changeover operation of the web 6 is described in FIG. 2A to FIG. 2H, and the winding operation of the web 6 is described in FIG. 2I.

Figure 2A:
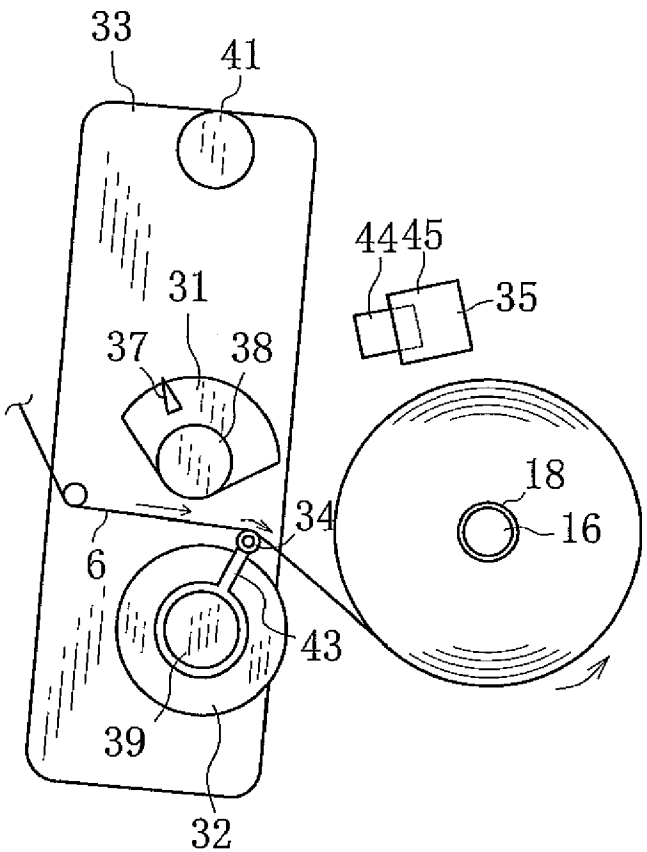
FIG. 2A shows a core fully winding a web.
Figure 3:
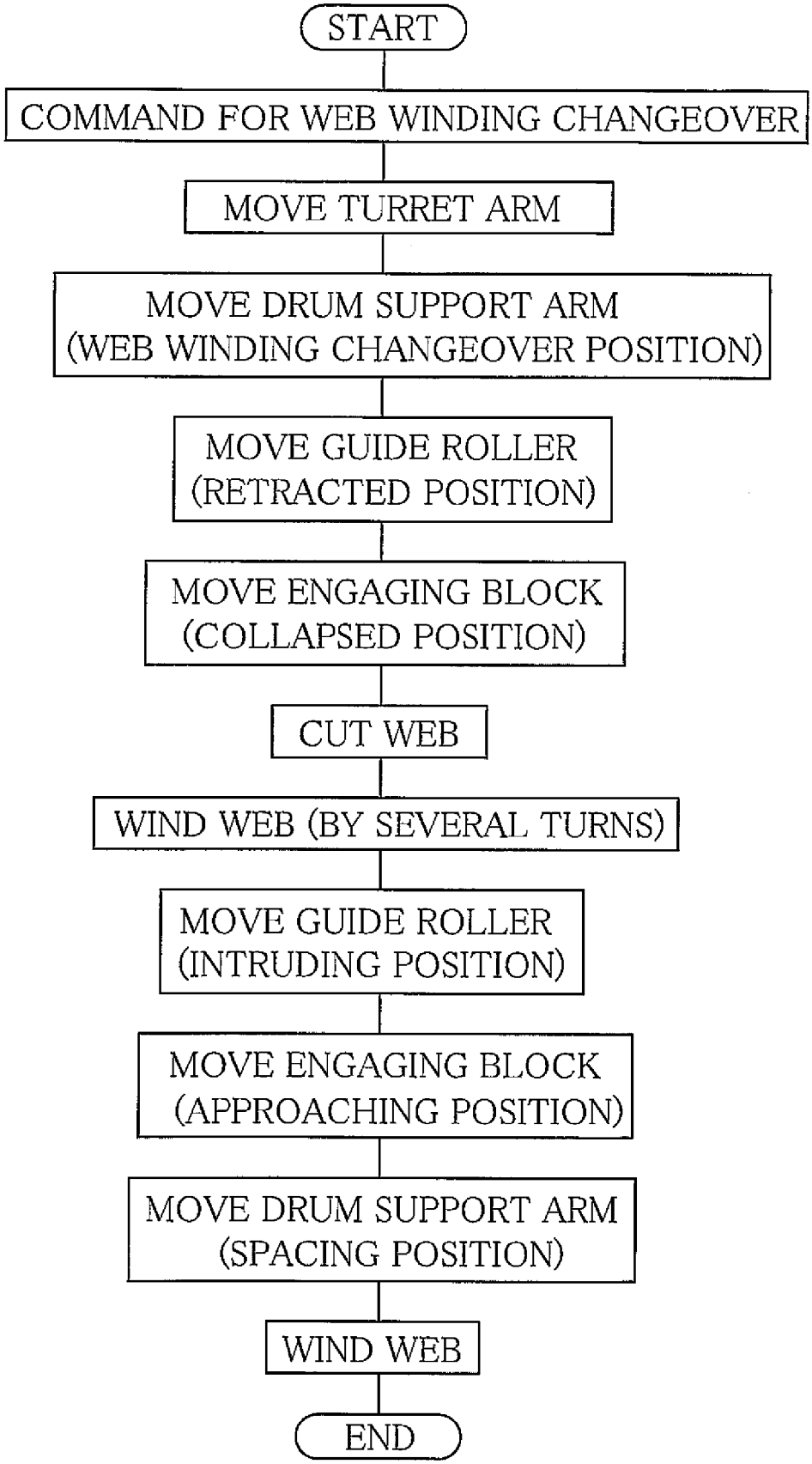
FIG. 3 is a flow chart showing an operation for changing over winding of the web.

As shown in FIG. 2A, the core 18 attached to the winding spindle 16 is in the fully wound state. At this time, the drum support arm 33 is located at the spacing position (initial position), the guide roller 34 is located at the approaching position, and the engaging block 44 is located at the protruding position. The guide roller 34 is driven to rotate in accordance with the transporting speed of the web 6.

Figure 2B:
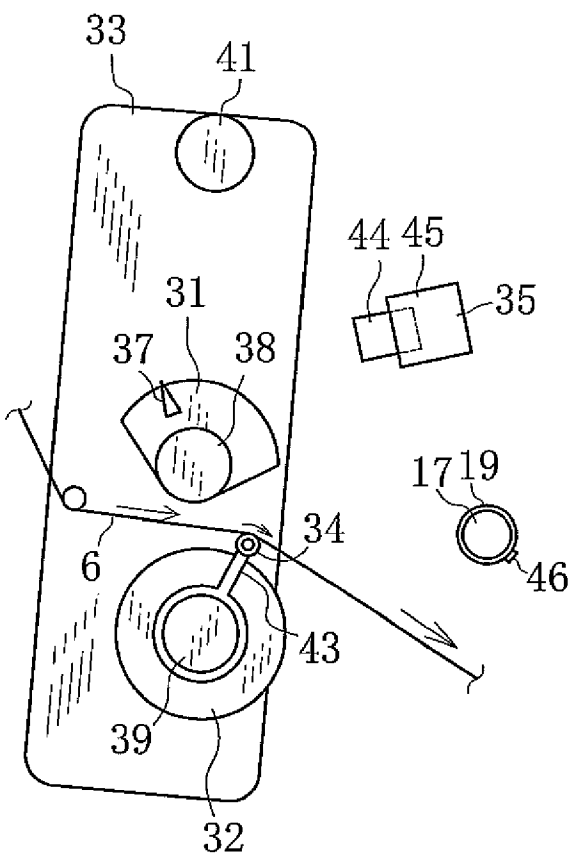
FIG. 2B shows a new core after moving to a winding position.

When the fully wound state of the core 18 is detected by the sensor for detecting fully wound state, the controller 13 gives a command for changing over winding of the web. The turret arm 11 and the auxiliary arm 12 make half a rotation (by 180°), and the winding spindle 17 to which the new core 19 is attached moves to the winding position as shown in FIG. 2B. The web roll wound around the core 18 moves to a side opposed to the winding position, and the winding spindle 16 continuously rotates to wind the web 6 guided by the roller 21.

Figure 2C:
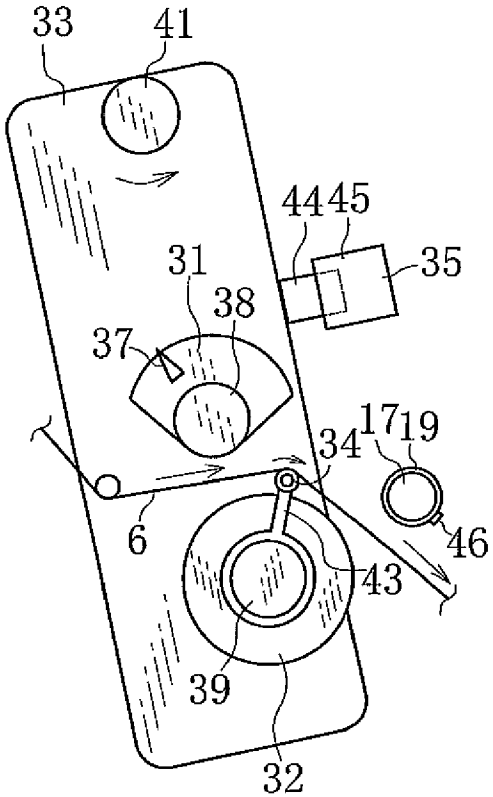
FIG. 2C shows a drum support arm after moving to a web winding changeover position.

Next, as shown in FIG. 2C, the drum support arm 33 moves to the web winding changeover position. However, since the engaging block 44 of the engaging mechanism 35 is located at the protruding position, the drum support arm 33 is engaged with the engaging block 44, and therefore the receiving drum 32 is away from the core 19. Further, when the drum support arm 33 moves to the web winding changeover position, simultaneously, the receiving drum 32 starts rotating in accordance with the transporting speed of the web 6.

Figure 2D:
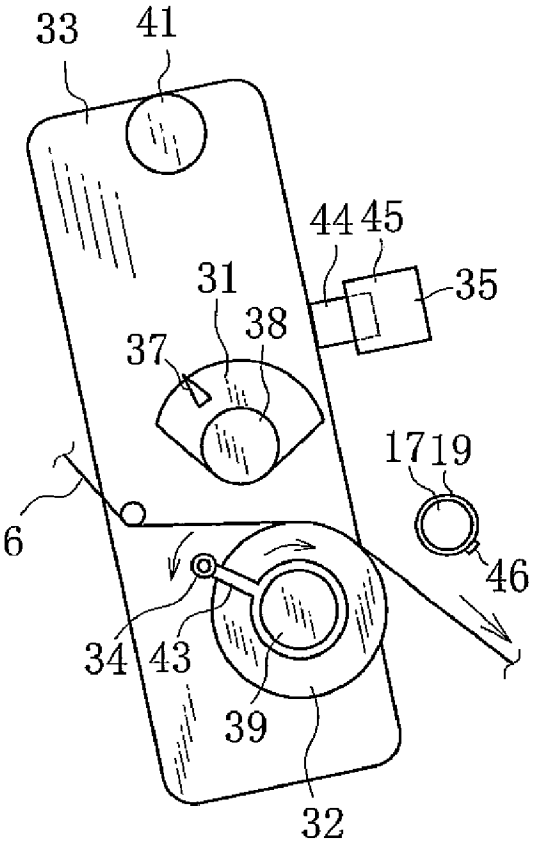
FIG. 2D shows a guide roller after moving to a retracted position.

As shown in FIG. 2D, after the drum support arm 33 moves to the web winding changeover position, the guide roller 34 moves to the retracted position. Thereby, the web 6 contacts the peripheral surface of the receiving drum 32. Note that, alternatively, during the movement of the drum support arm 33 toward the web winding changeover position, the guide roller 34 may move to the retracted position.

Figure 2E:
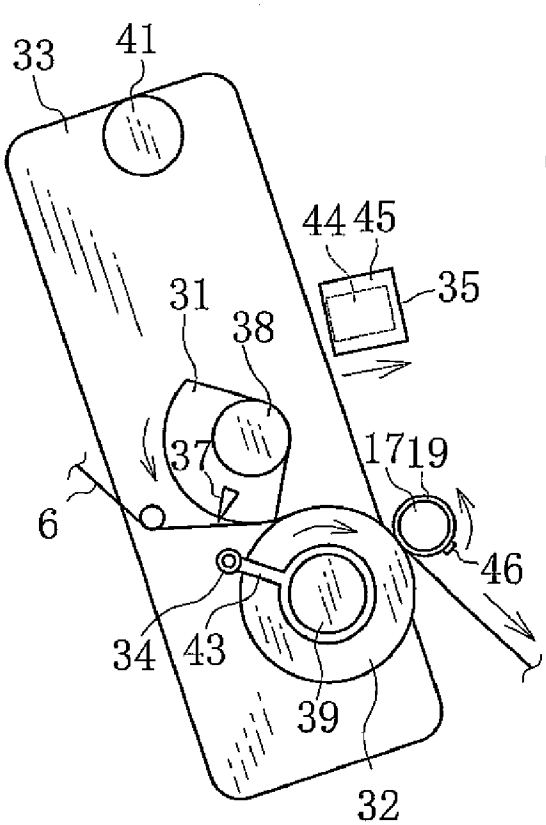
FIG. 2E shows a web nipped between a receiving drum and the core.

After the guide roller 34 moves to the retracted position, as shown in FIG. 2E, the cutting drum 31 and the winding spindle 17 (core 19) starts rotating. At the time of cutting the web 6, the cutting drum 31 rotates once. Further, the engaging block 44 of the engaging mechanism 35 moves to the collapsed position to channel the engagement with the drum support arm 33, and thereby the web 6 is nipped between the receiving drum 32 and the core 19. The timing for nipping is determined by the controller 13 based on the detection signal from the tape position detecting sensor, and controlled such that the double-sided adhesive tape 46 is located on the front end of the web 6 after being cut.

Figure 2F:
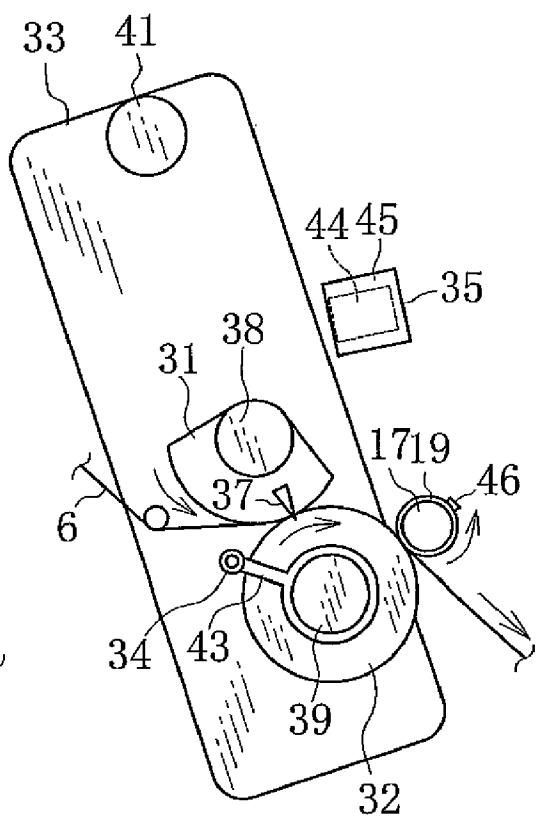
FIG. 2F shows the web at the time of being cut.

As shown in FIG. 2F, the cutter 37 of the cutting drum 31 is pressed against the peripheral surface of the receiving drum 32 to cut the web 6, and therefore the web 6 is divided into a web 6*a* at a downstream side in the transporting direction thereof and a web 6*b* at the upstream side in the transporting direction thereof.

Figure 2I:
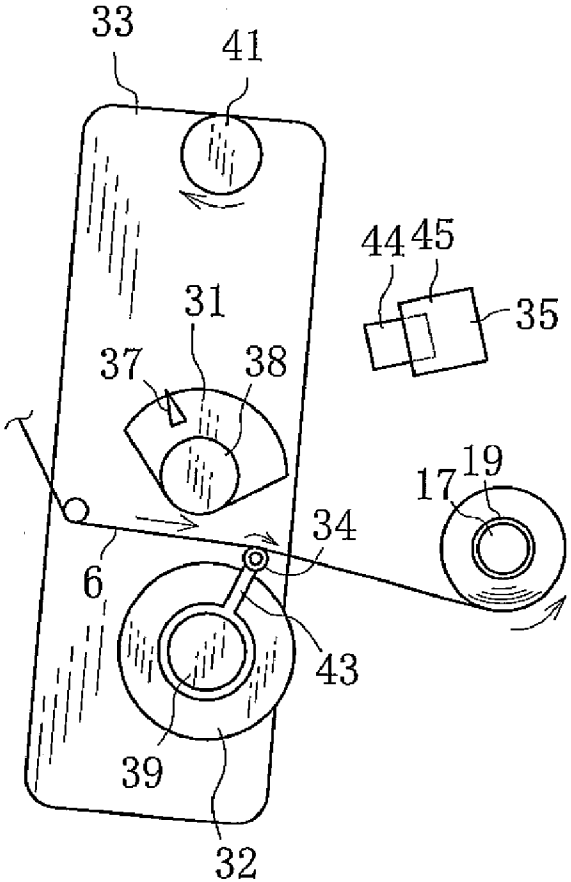
FIG. 2I shows the web at the time of being wound up.
Figure 2H:
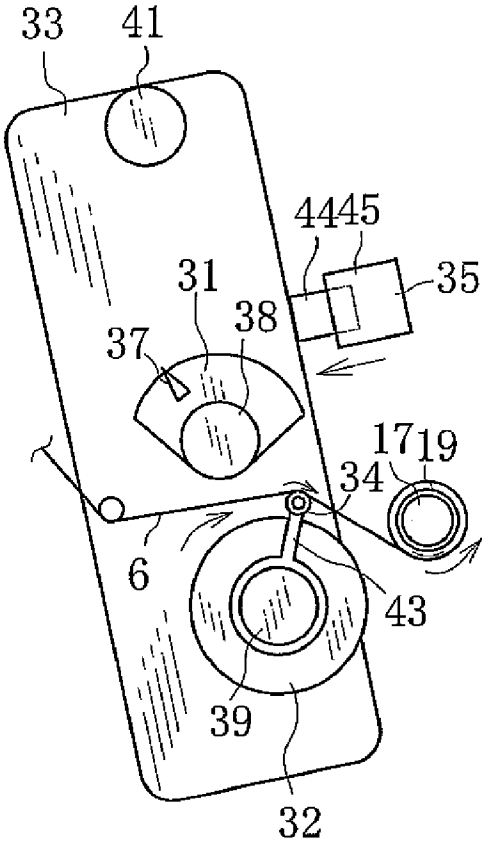
FIG. 2H shows the new core around which the web is wound by some turns.
Figure 2G:
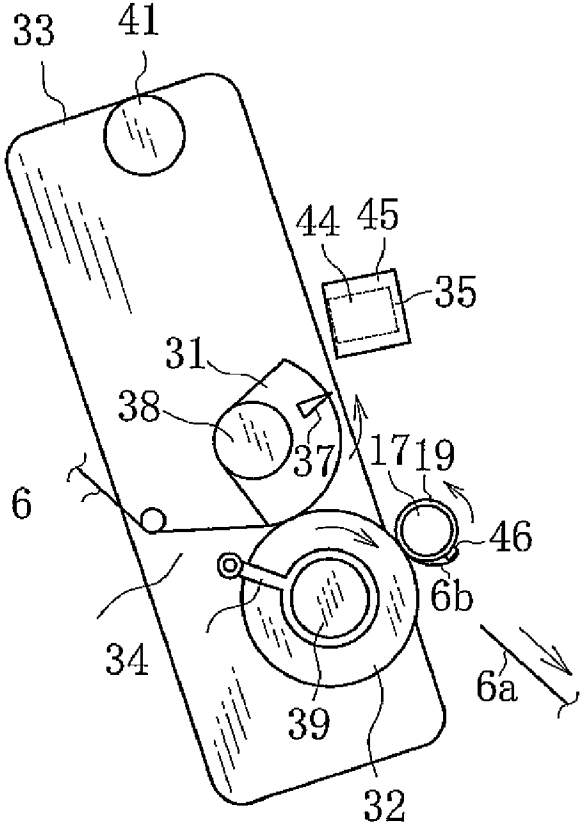
FIG. 2G shows the web fixed to the new core.

As shown in FIG. 2G, the front end of the web 6*b* at the upstream side in the transporting direction is adhered with the double-sided adhesive tape 46, and wound around the core 19 with the adhesive strength of the double-sided adhesive tape 46. While being nipped between the receiving drum 32 and the core 19, the web 6*b* at the upstream side in the transporting direction is wound around the core 19 by some turns. In this way, after being cut, the web 6*b* at the upstream side in the transporting direction is nipped between the receiving drum 32 and the core 19 for a while, and therefore the web 6*b* can be securely wound around the core 19.

On the contrary, the web 6*a* at the downstream side in the transporting direction is wound around the core 18 in the fully wound state. After winding the rear end of the web 6*a* at the downstream side in the transporting direction completely, the rotation of the winding spindle 16 is stopped. The web roll wound around the core 18 is removed from the winding spindle 16. To the winding spindle 16, a new core for next changeover is attached.

After the web 6 is wound around the core 19 by some turns, as shown in FIG. 2H, the guide roller 34 is driven to rotate in accordance with the transporting speed of the web 6 and moves to the approaching position. The web 6 moves away from the peripheral surface of the receiving drum 32. The engaging block 44 of the engaging mechanism 35 moves to the protruding position, and then the receiving drum 32 moves away from the core 19. After the web 6 moves away from the peripheral surface of the receiving drum 32, the receiving drum 32 stops rotating.

As shown in FIG. 2I, the drum support arm 33 moves to the spacing position, and the web 6 is wound around the core 19. Since the web 6 is wound around the core 19 without contacting the peripheral surface of the receiving drum 32, it is possible to prevent generation of scratches on the web 6. When the core 19 becomes the fully wound state, as described above, the winding changeover operation and the winding operation are repeated alternately.

According to the present invention, since having a cylindrical shape, the receiving drum 32 does not easily bend. Further, since the web 6 can be nipped between the receiving drum 32 and the core 19 in the unused state for a while after the cutting of the web 6, it is possible to surely change over winding of the web 6. Further, the guide roller 34 is provided to make it possible to prevent generation of scratches on the web 6. In particular, in a case where the web 6 is a protective film for a flat panel display device, the present invention is preferably applicable.

Note that, although the guide roller 34 is driven to rotate in the above embodiment, the guide roller 34 may rotate freely. Alternatively, it is also possible to adopt a configuration in which the guide roller 34 is driven to rotate when the transporting speed of the web 6 is lower than a predetermined speed, and the guide roller 34 rotates freely when the transporting speed of the web 6 exceeds the predetermined speed.

Although the position of the drum support arm 33 is adjusted with use of the engaging mechanism 35 in the above embodiment, if the movement of the drum support arm 33 can be controlled at high precision, it is unnecessary to use the engaging mechanism 35.

EXAMPLE 1

Hereinafter an example is shown. Conditions for winding operation are as follows. The material of the web 6 was cellulose triacetate (TAC) The thickness of the web 6 was 80 μm, and the width of the web 6 was 1400 mm. The tension applied to the web 6 was 50N/width. The transporting speed of the web 6 was 40 m/min. The diameter of each of the cores 18 and 19 was 169 mm. The diameter of each of the cutting drum 31 and the receiving drum 32 was 300 mm. The width of the double-sided adhesive tape 46 was 10 mm. The length of the double-sided adhesive tape 46 was 40 mm. The nip pressure between the receiving drum 32 and the core 18 or 19 was 0.4 MPa. Under the above conditions, the turret winder 2 was driven. As a result, it was possible to perform the web winding changeover operation and the winding operation without causing wrinkles, breakage, folds, and the like on the web 6.

The present invention is not to be limited to the above embodiments, and on the contrary, various modifications will be possible without departing from the scope and spirit of the present invention as specified in claims appended hereto.

What is claimed is:

1. A web winding changeover apparatus provided in a turret winder having a first winding spindle and a second winding spindle, a first core being removably attached to said first winding spindle, a second core being removably attached to said second winding spindle, and said web winding changeover apparatus changing over from a web winding around said first core to said second core, comprising:

a cutting drum disposed on a first side with respect to a transporting path of said web and having a cutter for cutting said web in a width direction thereof;

a receiving drum having a cross section of a circular shape disposed on a second side with respect to said transporting path;

a drum support arm for supporting each of said cutting drum and said receiving drum such that said cutting drum and said receiving drum rotate while peripheral surfaces of said cutting drum and said receiving drum contact each other at the time of cutting said web;

a shifter for shifting said drum support arm between a web winding changeover position for pressing a peripheral surface of said receiving drum against said second core and a spacing position for keeping said peripheral surface of said receiving drum away from said second core; and a guide roller shifting between an approaching position and a retracted position, in said approaching position said guide roller approaching said transporting path to guide said web while preventing said web from contacting said receiving drum, and in said retracted position said guide roller retracting from said transporting path to cause said web to contact said receiving drum.

2. A web winding changeover apparatus as defined in claim 1, wherein said guide roller moves to said approaching position when said drum support arm moves to said spacing position, and moves to said retracted position when said drum support arm moves to said web winding changeover position.

3. A web winding changeover apparatus as defined in claim 2, wherein said cutting drum has a cross section of a sector shape including a cutout portion, said cutout portion faces toward said transporting path of said web during winding of said web, and said cutting drum further rotates once to cut said web.

4. A web winding changeover apparatus as defined in claim 3, wherein said guide roller is present in said cutout portion of said cutting drum when being set to the approaching position.

5. A web winding changeover apparatus as defined in claim 4, wherein said guide roller is driven to rotate in accordance with a transporting speed of said web.

6. A web winding changeover apparatus as defined in claim 4, wherein said guide roller is supported by a rotatable guide roller support arm, and said guide roller support arm is coaxial with said receiving drum.

7. A web winding changeover method for changing over from a web winding around a first core to a second core, said first core being removably attached to a first winding spindle of a turret winder, said second core being removably attached to a second winding spindle of said turret winder, said web winding changeover method comprising the steps of:

retracting said first core having a web roll and setting said second core to a winding position simultaneously, moving a drum support arm supporting a cutting drum having a cross section of a sector shape and a receiving drum having a cross section of a circular shape from an initial position to a preparation position in front of a web winding changeover position, in said preparation position said receiving drum being kept away from said second core;

moving a guide roller from an approaching position to a retracted position, in said approaching position said guide roller lifting said web such that said web does not contact with a peripheral surface of said receiving drum, and in said retracted position said web contacting with said peripheral surface of said receiving drum;

rotating said receiving drum in accordance with a transporting speed of said web during movement of said guide roller;

moving said drum support arm to said web winding changeover position, in which said web is nipped between said receiving drum and said second core;

rotating said cutting drum once in contact with said receiving drum to cut said web, said cutting drum stopping at a position where said cutout portion faces toward said receiving drum after cutting of said web;

fixing a front end of said web formed by cutting to a periphery of said second core and starting winding of said web around said second core;

moving said guide roller to said approaching position; and moving said drum support arm to said initial position.

8. A web winding changeover method as defined in claim 7, wherein said guide roller is present in said cutout portion of said receiving drum at the time of being in said approaching position.

* * * * *